US007461752B2

(12) United States Patent
Li

(10) Patent No.: US 7,461,752 B2
(45) Date of Patent: Dec. 9, 2008

(54) FOLDABLE ARTICLE SUPPORT RACK

(76) Inventor: Xuliang Li, Kingsun Enterprises Co., Ltd. Hengjiang Industrial Park, Changping Town, Dongguan City, Guangdong 523565 (CN)

( * ) Notice: Subject to any disclaimer, the term of this patent is extended or adjusted under 35 U.S.C. 154(b) by 151 days.

(21) Appl. No.: 11/532,204

(22) Filed: Sep. 15, 2006

(65) Prior Publication Data

US 2007/0251907 A1 Nov. 1, 2007

(30) Foreign Application Priority Data

Apr. 25, 2006 (CN) ..... 2006 2 0058192 U

(51) Int. Cl.
*A47B 57/00* (2006.01)

(52) U.S. Cl. ..... 211/194; 211/195; 108/115; 108/163; 108/167

(58) Field of Classification Search ..... 211/134, 211/149, 175, 186, 188, 189, 194, 195, 198, 211/200–202; 108/115, 117, 163, 167, 170–173, 108/175, 176, 179, 188; 135/75, 139, 140, 135/143–145, 151; 248/150
See application file for complete search history.

(56) References Cited

U.S. PATENT DOCUMENTS

| | | | | | |
|---|---|---|---|---|---|
| 23,020 | A * | 2/1859 | Foster | 211/202 |
| 116,133 | A * | 6/1871 | Wright | 211/201 |
| 129,385 | A * | 7/1872 | Winship | 211/198 |
| 149,569 | A * | 4/1874 | Brown | 211/201 |
| 263,945 | A * | 9/1882 | Nelly | 211/200 |
| 421,540 | A * | 2/1890 | Barber | 211/132.1 |
| 997,079 | A * | 7/1911 | Moraff | 108/176 |
| 1,260,163 | A * | 3/1918 | Downie | 211/201 |
| 1,484,858 | A * | 2/1924 | Alexander | 108/166 |
| 1,666,692 | A * | 4/1928 | Epstein | 135/26 |
| 2,063,624 | A * | 12/1936 | Raab et al. | 135/75 |
| 2,459,024 | A * | 1/1949 | Gipson | 248/27.8 |
| 2,897,013 | A * | 7/1959 | Delp | 52/645 |
| 3,093,247 | A * | 6/1963 | Erickson | 108/188 |
| 4,673,092 | A * | 6/1987 | Lamson et al. | 211/188 |
| 4,703,702 | A * | 11/1987 | Speicher | 108/56.3 |
| 4,705,247 | A * | 11/1987 | Delmerico | 248/98 |
| 4,724,882 | A * | 2/1988 | Wang | 160/69 |
| 4,732,284 | A * | 3/1988 | Remmers | 211/188 |
| 4,740,010 | A * | 4/1988 | Moskovitz | 280/641 |
| 5,097,971 | A * | 3/1992 | Norris et al. | 211/126.6 |
| 5,131,547 | A * | 7/1992 | Goldberg | 211/149 |
| 6,295,669 | B1 * | 10/2001 | Saus | 5/116 |
| 6,341,614 | B1 * | 1/2002 | Tucker et al. | 135/75 |

(Continued)

*Primary Examiner*—Lanna Mai
*Assistant Examiner*—Joshua Rodden

(57) ABSTRACT

A foldable article support rack has a shelf-board and a plurality of bearing legs joined to the shelf-board at spaced locations to support the shelf-board steadily. The shelf-board includes two daughter boards that are connected in a manner to be foldable along a line. The foldable article support rack further includes telescopic link mechanisms connected to the daughter boards and the bearing legs. The telescopic link mechanisms are operable to selectively fold the daughter boards and the bearing legs into a plane for storage or stretch the daughter boards and the bearing legs for use. Therefore, manufacturers or merchants could assembly all components of the rack into finished product and fold it into a package for easy storage and transport and, in turn, consumers purchased the rack may immediately stretch it for use without troublesome assembling operation, while not in use, the consumers can fold it for sparing space.

4 Claims, 2 Drawing Sheets

U.S. PATENT DOCUMENTS 6,499,705 B1 * 12/2002 Tsai ..... 248/167
6,640,730 B2 * 11/2003 Tsai ..... 108/115
6,776,379 B2 * 8/2004 Sherer et al. ..... 248/150
6,877,622 B2 * 4/2005 Tsai ..... 211/195
7,296,699 B2 * 11/2007 Hung et al. ..... 211/189
2003/0106476 A1 * 6/2003 Tsai ..... 108/163
2006/0138066 A1 * 6/2006 Hung et al. ..... 211/189

* cited by examiner

FOLDABLE ARTICLE SUPPORT RACK

FIELD OF THE INVENTION

The present invention relates to a rack for articles, and more particularly to a foldable article support rack.

BACKGROUND OF THE INVENTION

As fashion changes, an increasing number of families are inclined to apply dedicate and light racks with high textural quality to arrange articles thereon. Generally, a typical rack comprises a shelf-board for placing objects and a plurality of legs for supporting the shelf-board. Such racks are light, simple, elegant, and reliable in structure, which may illuminate the modern domestic decoration with regnant fashion. However, for the purposes of storage and transport, manufacturers or merchants usually pack up disassembled parts and accessories of the rack with a case. Accordingly, upon purchase consumers may be faced with a troublesome task of assembling the confusing components together again, which is time-consuming and laborious. Moreover, these racks would occupy much more room and sometimes cause inconvenience especially when no articles need lying upon the racks.

Hence, a need has arisen for providing an improved rack to overcome the aforementioned problems.

SUMMARY OF THE INVENTION

Accordingly, an object of the present invention is to provide a foldable article support rack with telescopic link mechanisms which are operable to selectively stretch the rack for use or fold the rack into a plane for storage, thus sparing space and being convenient for user.

To achieve the above-mentioned object, a foldable article support rack includes a shelf-board and a plurality of bearing legs joined to the shelf-board at spaced locations to support the shelf-board steadily. The shelf-board comprises at least two daughter boards that are interconnected in a manner to be foldable along a line. The foldable article support rack further comprises telescopic link mechanisms connected to the daughter boards and the bearing legs, and the telescopic link mechanisms are operable to selectively fold or stretch the daughter boards and the bearing legs.

In the invention, the telescopic link mechanisms respectively pivotally connect between ends of the daughter boards on the line and the bearing legs. Preferably, each telescopic link mechanism includes a tubular shaft, connection rods, a slidable fastener, and a fastener cap. The daughter boards pivotally connect to a top end of the tubular shaft. The fastener cap is fixed to the tubular shaft. The slidable fastener is slidably disposed on the tubular shaft and is slidable between a first position where the slidable fastener latches with the fastener cap to latch the rack in the stretched state and a second position where the slidable fastener is free to keep the rack in the folded state. Each connection rod has one end pivotally connected to the slidable fastener and the other end pivotally connected to one of the bearing legs.

As an embodiment of the present invention, the number of the bearing legs is four, the numbers of the daughter boards and the telescopic link mechanisms are two respectively. Each telescopic link mechanism is connected between the two daughter boards and two of the bearing legs.

Preferably, the slidable fastener has a latching block projected from an outer surface thereof, and the fastener cap has a latching recess recessed in an inner surface thereof for latching with the latching block. The fastener cap further has a button which is operable to release the latching block.

Preferably, each slidable fastener defines two holes, each bearing leg defines one hole, and two ends of each connection rod are bend ends which are inserted respectively into the corresponding holes of the slidable fastener and the bearing leg.

More preferably, the daughter boards are metal net sheets.

Equipped with the telescopic link mechanisms, the present rack allows manufacturers or merchants to be able to assembly all components of the rack into finished product and fold the finished rack into a package for easy storage and transport and, in turn, consumers purchasing the rack may immediately stretch it for use without troublesome and laborious assembling operation, and while not in use, the consumers can fold it for sparing space.

Other aspects, features, and advantages of this invention will become apparent from the following detailed description when taken in conjunction with the accompanying drawings, which are a part of this disclosure and which illustrate, by way of example, principles of this invention.

DETAILED DESCRIPTION OF ILLUSTRATED EMBODIMENTS

Figure 1:
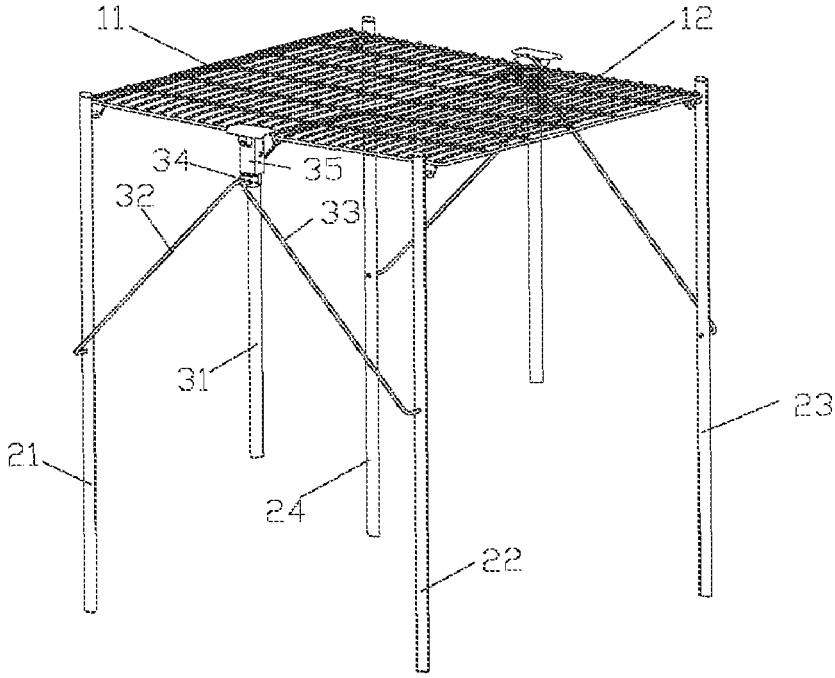
FIG. 1 is a perspective view of a foldable article support rack according to the present invention, showing the foldable article support rack in the stretched state.

Various preferred embodiments of the invention will now be described with reference to the figures, wherein like reference numerals designate similar parts throughout the various views. As indicated above, the invention is directed to a foldable article support rack, which comprises a shelf-board and a plurality of bearing legs in a spaced apart relation to one another to support the shelf-board securely and steadily. The shelf-board includes multiple daughter boards that are interconnected in a manner to be foldable along a line. Telescopic link mechanisms are provided to connect the daughter boards and the bearing legs, and the telescopic link mechanisms are operable to selectively fold or stretch the daughter boards and the bearing legs.

Referring now to FIGS. 1-4, the shelf-board of the exemplary embodiment has two daughter boards which will be described as the first daughter board 11 and the second daughter board 12 respectively. The foldable article support rack has four bearing legs 21, 22, 23, 24. It should be understood that the daughter boards 11, 12 are preferably metal net sheets, but they could be any shape and structure so long as are suitable for supporting articles. Also, it will be appreciated that the number of the bearing legs and the daughter boards of the shelf-board can be more or less than the above-given and still be within the scope of the present invention.

The foldable article support rack in accordance with the present invention further comprises a plurality of telescopic link mechanisms pivotally connected to the daughter boards 11, 12 and the bearing legs 21, 22, 23, 24. The telescopic link mechanisms are operable to selectively control the daughter boards 11, 12 and bearing legs 21, 22, 23, 24 to be folded or stretched, a detailed description of which will be given hereinafter. Concretely, the telescopic link mechanisms respectively pivotally connect between ends of the two daughter boards 11, 12 on the fold line and the approximate midpoint of the bearing legs 21, 22, 23, 24. Alternatively, the telescopic link mechanisms can also joint to the upper points or lower points of the bearing legs 21, 22, 23, 24, which could also gain advantageous effects similar to the above structure.

Figure 2:
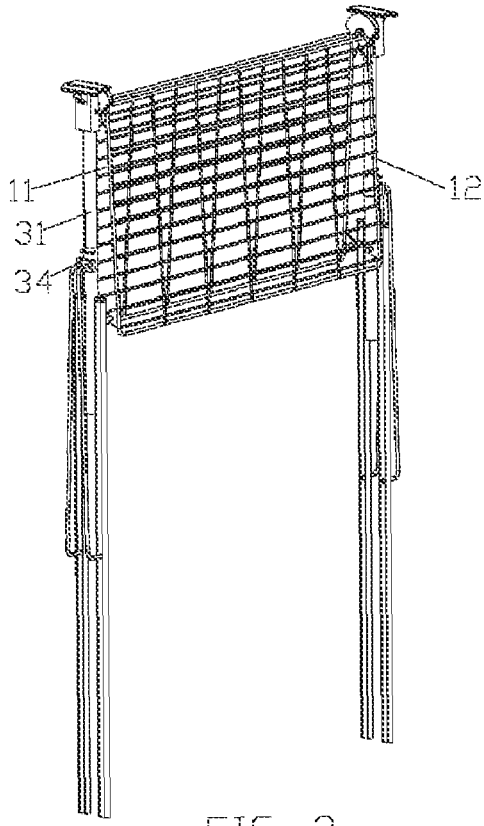
FIG. 2 is a perspective view of the foldable article support rack in the folded state.
Figure 3:
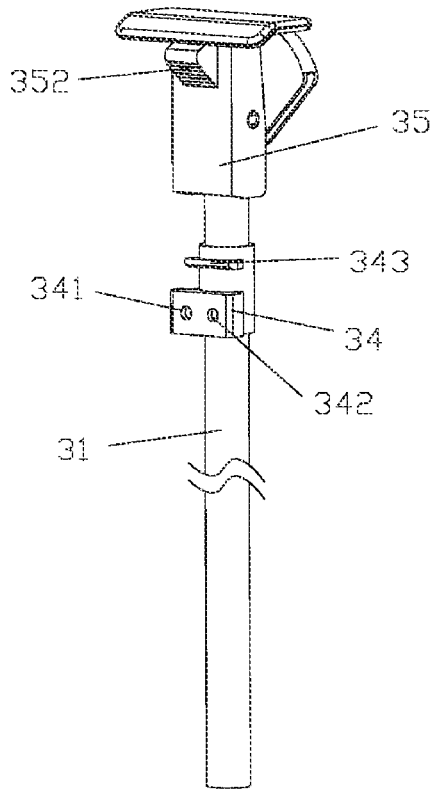
FIG. 3 is a perspective view of a telescopic link mechanism for the foldable article support rack.
Figure 4:
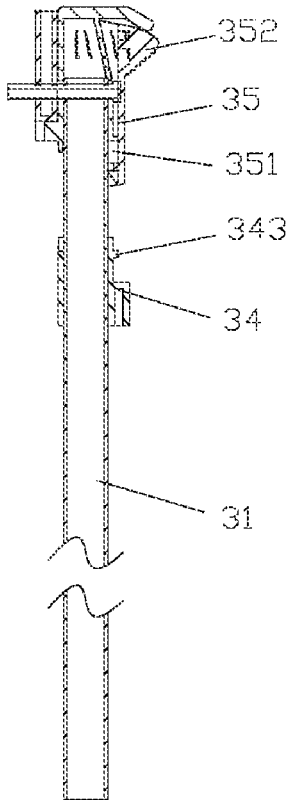
FIG. 4 is an axial cross-sectional view of the telescopic link mechanism of FIG. 3.

Preferably, the foldable article support rack has two telescopic link mechanisms, one of which is connected between one end of the two daughter boards 11, 12 on the fold line and two bearing legs 21, 22, the other of which is connected between the opposite end the two daughter boards 11, 12 on the fold line and the rest two bearing legs 23, 24. Turning now to FIGS. 3 and 4, details of a novel and unique telescopic link mechanism of the foldable article support rack of the present invention are shown. Each telescopic link mechanism includes a tubular shaft 31, two connection rods 32, 33 (shown in FIGS. 1 and 2), a slidable fastener 34, and a fastener cap 35. The daughter boards 11, 12 pivotally connect to a top end of the tubular shaft 31. The fastener cap 35 is fixed to the top end of the tubular shaft 31, while the slidable fastener 34 is slidably disposed on the tubular shaft 31 and is slidable between a first position where the slidable fastener 34 latches with the fastener cap 35 to latch the rack in the stretched state (as shown in FIG. 1) and a second position where the slidable fastener 34 is free to keep the rack in the folded state (as shown in FIG. 2) . Each connection rod 32 or 33 has one end pivotally connected to the slidable fastener 34 and the other end pivotally connected to one of the bearing legs 21, 22, 23, or 24. Preferably, each slidable fastener 34 defines two holes 341, 342, each bearing leg 21, 22, 23, or 24 defines one hole (shown in FIG. 1, not labeled), and two ends of each connection rod 32 or 33 are bend ends which are inserted respectively into the corresponding holes of the slidable fastener 34 and the corresponding bearing leg 21, 22, 23, or 24. For example, as shown in FIG. 1, one bend end of the connection rod 32 is pivotally inserted into the hole the slidable fastener 34, the other end of the connection rod 32 is pivotally inserted into the hole of the bearing leg 21. The slidable fastener 34 further has a latching block 343 projected from an outer surface thereof, while the fastener cap 35 has a corresponding latching recess 351 recessed in an inner surface thereof for engaging with the latching block 343 to releasably lock the rack in the stretched state. The fastener cap 35 further provides a button 352 which is operable to release the latching block 343 from the latching recess 351, thereby facilitating operation of folding the rack.

Referring to FIG. 1, it can be seen that when the foldable article support rack is in open state, the first daughter board 11 and the second daughter board 12 integrally form a plane for supporting articles. The connection rods 32, 33 are also stretched serving to support the daughter boards 11, 12. Each connection rod 32 or 33 is particularly important in that it provides a secure structural configuration for prevention further rotation of the first daughter board 11 relative to the second daughter board 12. FIG. 2 is a view illustrating the closed condition of the foldable article support rack wherein the slidable fastener 34 is released from the fastener cap 35 and slides to the second position. Along with the sliding, the first daughter board 11, the second daughter board 12, the four legs 21, 22, 23, 24, and the connection rods 32, 33 are folded into a plane.

When to use the rack, it is necessary to turn the two folded daughter boards 11, 12 of the shelf-board outwardly. Accordingly this action yields a tractive force impacted on the connection rods 32, 33. The force in turn actuates the slidable fastener 34 disposed on the tubular shaft 31 to slide upwards. When the two daughter boards 11, 12 are stretched into a horizontal plane, the slidable fastener 34 slides to the first position, and the latching block 343 automatically latches into the latching recess 351 to latch the rack in the stretched state. When not in use, pressing the button 352 of the fastener cap causes the latching block 343 to release from the latching recess 351. Accordingly, the two daughter boards 11, 12 are turned inwardly till the first daughter board 11 is being fully folded up to the second daughter board 12. At the same time, due to a tractive force applied by the connection rods 32, 33, the slidable fastener 34 slidably moves downward along the tubular shaft 31, which allows the foldable article support rack to be folded.

Accordingly, the foldable article support rack of the present invention is more compact and portable than the prior rack. As a result, manufacturers or merchants can assembly all components of the rack into finished product and fold the finished rack into a package for easy storage and transport and, in turn, consumers purchased the rack may immediately stretch it for use without troublesome and laborious assembling operation, while not in use, the consumers can fold it for sparing space.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A foldable article support rack, comprising: a shelf-board;

a plurality of bearing legs joined to the shelf-board at spaced locations to support the shelf-board steadily;

the shelf-board comprising at least two daughter boards that are interconnected in a manner to be foldable along a line;

a plurality of telescopic link mechanisms connected to the daughter boards and the bearing legs, the telescopic link mechanisms are operable to selectively fold or stretch the daughter boards and the bearing legs;

each telescopic link mechanism including a tubular shaft, connection rods, a slidable fastener, and a fastener cap, the daughter boards pivotally connect to a top end of the tubular shaft, the fastener cap is fixed to the tubular shaft, the slidable fastener is slidably disposed on the tubular shaft and is slidable between a first position where the slidable fastener latches with the fastener cap to latch the rack in the stretched state and a second position where the slidable fastener is free to keep the rack in the folded state, each connection rod has one end pivotally connected to the slidable fastener and the other end pivotally connected to one of the bearing legs, the slidable fastener having a latching block projected from an outer surface thereof, the fastener cap having a latching recess recessed in an inner surface thereof for latching with the latching block, the fastener cap further having a button which is operable to release the latching block.

2. The foldable article support rack according to claim 1, wherein the number of the bearing legs is four, the number of the daughter boards and the telescopic link mechanisms are two respectively, and each telescopic link mechanism is connected between the two daughter boards and two of the bearing legs.

3. The foldable article support rack according to claim 1, wherein each slidable fastener defines two holes, each bearing leg defines one hole, two ends of each connection rod are bend ends which are inserted respectively into the corresponding holes of the slidable fastener and the bearing leg.

4. The foldable article support rack according to claim 1, wherein the daughter boards are metal net sheets.

* * * * *